US007431019B2

(12) United States Patent
Kubota

(10) Patent No.: US 7,431,019 B2
(45) Date of Patent: Oct. 7, 2008

(54) FUEL SUPPLY DEVICE

(75) Inventor: Kazuya Kubota, Saitama (JP)

(73) Assignee: Bosch Corporation, Tokyo (JP)

( * ) Notice: Subject to any disclaimer, the term of this patent is extended or adjusted under 35 U.S.C. 154(b) by 0 days.

(21) Appl. No.: 10/591,148

(22) PCT Filed: Mar. 3, 2005

(86) PCT No.: PCT/JP2005/004159

§ 371 (c)(1),
(2), (4) Date: Jun. 29, 2007

(87) PCT Pub. No.: WO2005/085625

PCT Pub. Date: Sep. 15, 2005

(65) Prior Publication Data

US 2008/0041341 A1 Feb. 21, 2008

(30) Foreign Application Priority Data

Mar. 5, 2004 (JP) ..... 2004-062152

(51) Int. Cl.
*F02M 69/46* (2006.01)
*F02M 69/52* (2006.01)

(52) U.S. Cl. ..... 123/456; 123/514

(58) Field of Classification Search ..... 123/456, 123/447, 495, 506, 508, 510, 511, 514, 446, 123/458; 417/26
See application file for complete search history.

(56) References Cited

U.S. PATENT DOCUMENTS 4,016,719 A * 4/1977 Yavnai ..... 60/416
4,459,963 A * 7/1984 Gross et al. ..... 123/506
4,621,605 A * 11/1986 Carey et al. ..... 123/446
5,094,216 A * 3/1992 Miyaki et al. ..... 123/506
5,404,855 A * 4/1995 Yen et al. ..... 123/446
5,579,640 A * 12/1996 Gray et al. ..... 60/413

(Continued)

FOREIGN PATENT DOCUMENTS

JP 04-072455 3/1992

(Continued)

OTHER PUBLICATIONS

International Search Report No. PCT/JP2005/004159, dated Jun. 7, 2005, 4 pgs.

*Primary Examiner*—Mahmoud Gimie
(74) *Attorney, Agent, or Firm*—Connolly Bove Lodge & Hutz LLP

(57) ABSTRACT

In a fuel supply device 1 in which high-pressure fuel in the inside of a common rail 2 which accumulates the high-pressure fuel supplied from a fuel pump 6 under pressure is supplied to an internal combustion engine by fuel injection valves, and the fuel pump 6 includes a plurality of high-pressure plungers 61 to 64 whose high-pressure-fuel injection timings are shifted from each other, a portion or all of high-pressure pipes 11 to 14 which connect fuel outlet ports 6P1 to 6P4 of high-pressure plungers 61 to 64 with the common rail 2 are connected with each other by connection pipes 30 to 33 thus establishing a state in which the high-pressure fuel from substantially one high-pressure plunger is supplied using the plurality of high-pressure pipes whereby the elevation of fuel pressures in the inside of the high-pressure pipes can be suppressed.

1 Claim, 4 Drawing Sheets

U.S. PATENT DOCUMENTS

| | | | | |
|---|---|---|---|---|
| 6,053,147 | A * | 4/2000 | Hemmerlein et al. | 123/447 |
| 6,112,710 | A * | 9/2000 | Egan et al. | 123/90.12 |
| 6,786,205 | B2 * | 9/2004 | Stuhldreher et al. | 123/495 |
| 2003/0010319 | A1 * | 1/2003 | Ishimoto | 123/446 |
| 2004/0129255 | A1 * | 7/2004 | Stuhldreher et al. | 123/447 |
| 2004/0154594 | A1 * | 8/2004 | Miyashita | 123/458 |
| 2006/0120880 | A1 * | 6/2006 | Shafer et al. | 417/245 |

FOREIGN PATENT DOCUMENTS

| | | |
|---|---|---|
| JP | 11-044276 | 2/1999 |
| JP | 2002-295337 | 10/2002 |

* cited by examiner

FUEL SUPPLY DEVICE

TECHNICAL FIELD

The present invention relates to a fuel supply device which is configured to supply high-pressure fuel from a fuel pump to a common rail, to accumulate the high-pressure fuel in the common rail, and to supply the fuel inside the common rail to an internal combustion engine.

BACKGROUND ART

There has been known a fuel supply device which is constituted of a fuel pump, a common rail which accumulates a high-pressure fuel supplied under pressure from the fuel pump, and fuel injection valves which are provided for respective cylinders of an internal combustion engine and are capable of supplying the high-pressure fuel accumulated in the common rail, and is referred to as a common rail system. In this type of the fuel supply device, as shown in FIG. 1 of JP-A-2001-263198, respective outlet ports of the fuel pump and the common rail are connected with each other by way of two high-pressure pipes which are provided independently from each other, and the high-pressure fuel from the respective outlet ports are supplied to the common rail by way of these two high-pressure pipes.

In this manner, the fuel pump which arranges high-pressure generating portions in a row adopts piping in which the fuel pump and the rail are connected with each other by a high-pressure pipe for every cylinder and hence, with respect to the fuel pump which is required to allow a large quantity of fuel to pass therethrough, a flow rate per hour that is allocated to one high-pressure generating portion becomes considerably large. Accordingly, due to throttling of an inner-diameter portion of the high-pressure pipe which is connected to the high-pressure outlet portion, the pressure is elevated at an outlet portion thus giving rise to a drawback with respect to the reliability of the high-pressure generating portion.

That is, in the conventional fuel supply device, a pressure resistance design having a sufficient margin with respect to an upper limit of the pressure fluctuation is usually performed by taking a lifetime of a product into consideration. However, in case that the pressure fluctuation of the fuel injected from the fuel pump is large, it is necessary to increase the pressure resistance value of the whole system including a fuel injection valve, a common rail, a pipe which connects the fuel pump and the common rail, a pipe which connects the common rail and the fuel injection valve and the like to a value which exceeds the necessary pressure resistance. Although it may be possible to suppress the elevation of pressure by increasing an inner diameter of the pipe, there may be a case that the sufficient inner diameter cannot be ensured due to the restriction imposed on strength, a mounting size and the like of the pipe. Further, when the pressure fluctuation is large, there arise drawbacks such as the increase of weight attributed to the increase of a wall thickness of constitutional parts and the complication of the structure attributed to the pressure resistance design.

It is an object of the present invention to provide a fuel supply device which can overcome the above-mentioned drawbacks of the related art.

It is also an object of the present invention to provide a fuel supply device which can suppress the elevation of pressure in the inside of a high-pressure pipe in comparison with a related art.

It is another object of the present invention to provide a fuel supply device which can realize the reduction of weight and the miniaturization thereof.

DISCLOSURE OF THE INVENTION

To overcome the above-mentioned drawbacks, according to the present invention, in the constitution which supplies a high-pressure fuel which is pressurized by fuel pumps whose injection timings are shifted from each other to a common rail by way of a plurality of high pressure pipes, a portion or the whole high-pressure pipes are connected with each other by connection pipes between fuel outlet ports of the fuel pumps and a fuel input port of the common rail, it is possible to provide a state in which the high-pressure fuel from substantially one high-pressure generating part is supplied using a plurality of pipe passages thus suppressing the elevation of the fuel pressure inside the high pressure pipes.

The present invention is characterized in that in a fuel supply device which includes a fuel pump, a common rail which accumulates a high-pressure fuel which is supplied from the fuel pump under pressure, and a fuel injection valve which is capable of supplying the high-pressure fuel accumulated in the inside of the common rail to an internal combustion engine, wherein the fuel pump includes a plurality of high-pressure generating portions whose high-pressure-fuel injection timings are shifted from each other, the fuel supply device includes a plurality of high-pressure pipes which are provided corresponding to the plurality of high-pressure generating portions and connect fuel outlet ports of the corresponding high-pressure generating portions and the common rail, and a connection pipe which connects at least two or more high-pressure pipes out of the plurality of high-pressure pipes with each other in the vicinity of the corresponding fuel outlet ports.

The high-pressure fuel is supplied from the plurality of the high-pressure generating portions at different timings, and the high-pressure fuel is supplied to the inside of the common rail from the corresponding fuel outlet port through the high-pressure pipe which is connected to the fuel outlet port. Here, although the inner pressure of the high-pressure pipe is sharply elevated, a portion of the high-pressure fuel escapes to the separate high-pressure pipe which is connected to the high-pressure generating portion which is not at the high-pressure injection timing by way of the connection pipe. As the result, the elevation of the inner pressure of the high-pressure pipe can be suppressed to a low level compared to a corresponding conventional high-pressure pipe.

According to the present invention, with the provision of the connection pipe, the high-pressure fuel from the corresponding high-pressure generating portion is distributed into the plurality of high-pressure pipes and is supplied to the common rail and hence, the elevation of the pressure in the inside of the respective high-pressure pipes can be effectively suppressed. As a result, it is unnecessary to impart an extra strength to the fuel pump and the high-pressure pipe and hence, it is possible to realize the reduction of weight and the miniaturization of the device and the reduction of cost attributed to the reduction of weight and the miniaturization of the device. Further, it is possible to realize the enhancement of the reliability, the reduction of the driving torque and the enhancement of power efficiency.

BEST MODE FOR CARRYING OUT THE INVENTION

The present invention is explained in conjunction with attached drawings for describing the invention in more detail.

Figure 1:
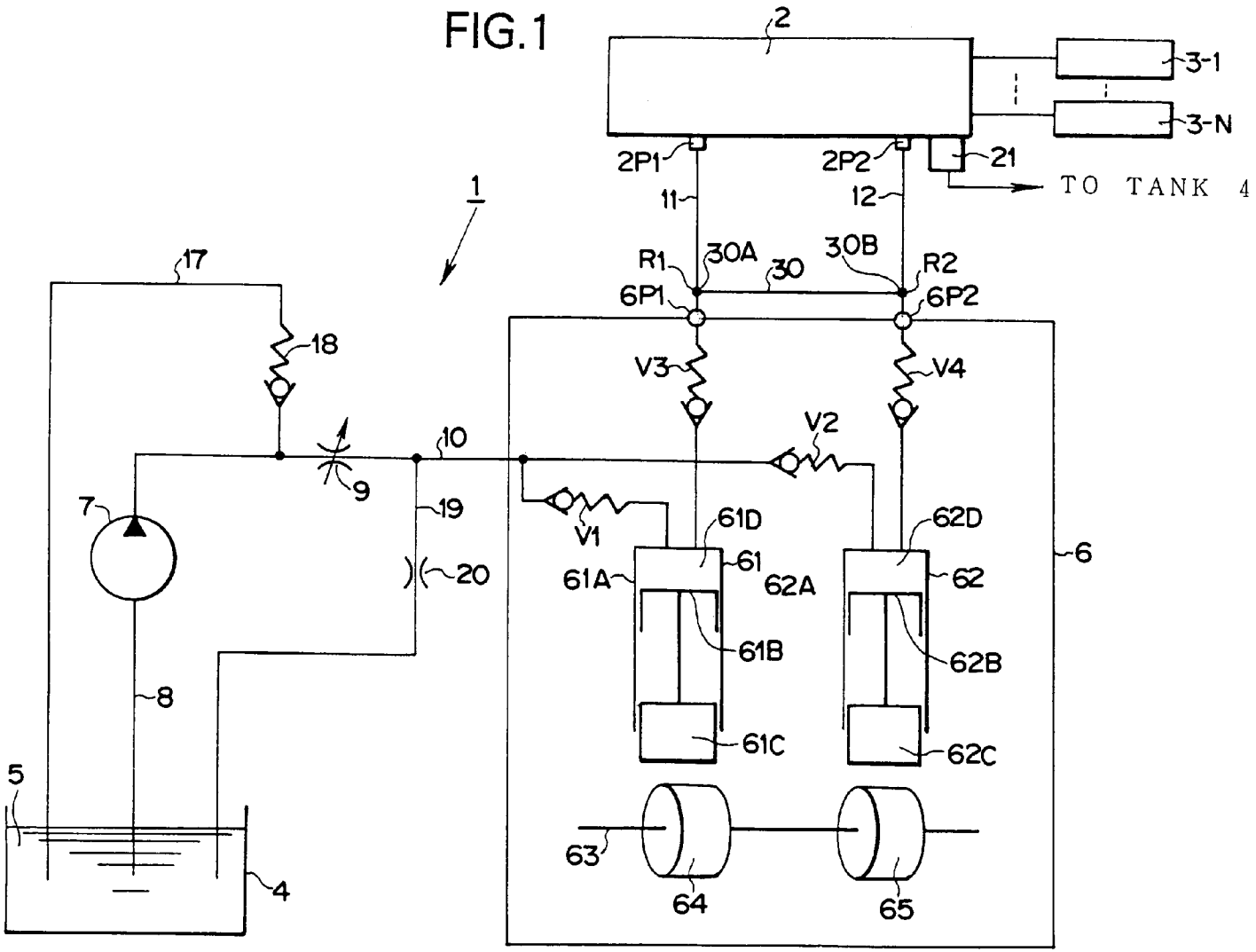
FIG. 1 is a constitutional view showing one example of an embodiment of the present invention.

FIG. 1 is a schematic constitutional view showing one embodiment of the present invention. A fuel supply device 1 shown in FIG. 1 is a common-rail type fuel supply device in which a high-pressure fuel is accumulated in the inside of the common rail 2 and the high-pressure fuel is injected and supplied to respective cylinders (not shown in the drawing) of an internal combustion engine by injectors 3-1 to 3-N. A pressure control valve 21 for adjusting a fuel pressure inside the common rail 2 to a desired value is provided to the common rail 2. The injectors 3-1 to 3-N are provided for respective cylinders and are subject to an open/close control by an injection control unit which is constituted of a microcomputer (not shown in the drawing).

In FIG. 1, numeral 4 indicates a tank for accumulating fuel 5, numeral 6 indicates a fuel pump (a supply pump), and numeral 7 indicates a low-pressure pump which is provided to a low-pressure side of the fuel pump 6 as a feed pump. The fuel 5 in the inside of the tank 4 is pumped up by a low-pressure pump 7 by way of a fuel pipe 8. The low-pressure fuel from the low-pressure pump 7 passes through an oil supply passage 10 on which a flow rate control valve 9 for adjusting a quantity of fuel which is supplied to the fuel pump 6 is provided, and is supplied to suction valves V1, V2 of the fuel pump 6. Here, numeral 17 indicates a return oil passage, numeral 18 indicates a pressure valve which adjusts a front-side pressure of the flow-rate control valve 9, and numeral 19 indicates a return oil passage at the time of non-injection having a zero delivery orifice 20.

In this embodiment, the fuel pump 6 includes two high-pressure plungers 61, 62 which form high-pressure generating portions, wherein these high-pressure plungers 61, 62 are driven by cams 64, 65 which are fixed to a cam shaft 63 which is rotated by a rotating force from the internal combustion engine not shown in the drawing.

The high-pressure plunger 61 is configured such that a piston 61B is housed in the inside of a cylinder 61A in a reciprocating manner along an axis thereof. Due to a tappet 61C which is cooperatively operated with the cam 64, a piston 61B is reciprocated corresponding to the rotation of the cam 64 so as to pressurize the low-pressure fuel supplied to the inside of the plunger chamber 61D which is defined by the piston 61B by way of the suction valve V1. The high-pressure fuel obtained by such an operation is fed from an outlet check valve V3 which opens in the direction toward the common rail 2.

Here, an outlet port of the outlet check valve V3 constitutes a fuel outlet port 6P1 of the high-pressure plunger 61, and the high-pressure fuel from the high-pressure plunger 61 is fed to the inside of the common rail 2 by way of the high-pressure pipe 11 which is arranged between an inlet port 2P1 of the common rail 2 and the fuel outlet port 6P1.

Although the explanation has been made with respect to the constitution of the high-pressure plunger 61 side heretofore, the high-pressure plunger 62 side is also constituted in the same manner. That is, in the high-pressure plunger 62, a piston 62B is housed in the inside of a cylinder 62A in a reciprocating manner along an axis thereof. Due to a tappet 62C which is cooperatively operated with the cam 65, a piston 62B is reciprocated corresponding to the rotation of the cam 65. Here, the cam 64 and the cam 65 are mounted on the cam shaft 63 with their phases shifted from each other.

Accordingly, the low-pressure fuel which is supplied to the inside of the plunger chamber 62D defined by the piston 62B by way of the suction valve V2 is pressurized. The high-pressure fuel obtained by such an operation is fed from an outlet check valve V4 which opens in the direction toward the common rail 2. However, the injection timing lag is present between the injection of the high-pressure fuel from the high-pressure plunger 61 and the injection of the high-pressure fuel from the high-pressure plunger 62 thus eliminating the possibility of simultaneous injection of the high-pressure fuel.

Here, an outlet port of the outlet check valve V4 constitutes a fuel outlet port 6P2 of the high-pressure plunger 62, and the high-pressure fuel from the high-pressure plunger 62 is fed to the inside of the common rail 2 by way of the high-pressure pipe 12 which is arranged between an inlet port 2P2 of the common rail 2 and the fuel outlet port 6P2.

Due to the high-pressure fuel which is respectively injected from the high-pressure plungers 61 and 62, pressures act on the high-pressure pipes 11, 12 which are provided corresponding to the high-pressure plungers 61 and 62. To largely reduce such pressures, between the high-pressure pipes 11, 12, a connection pipe 30 which brings the high-pressure pipes 11, 12 into a communication state with each other is arranged.

In this embodiment, to make the high-pressure pipes 11, 12 communicate with each other at a position R1 close to the fuel outlet port 6P1 of the high-pressure pipe 11 and at a position R2 close to the fuel outlet port 6P2 of the high-pressure pipe 12, one end 30A of the connection pipe 30 is connected to the high-pressure pipe 11 at the position R1 and another end 30B of the connection pipe 30 is connected to the high-pressure pipe 12 at the position R2. By providing the connection pipe 30 between the high-pressure pipes 11, 12 as described above, when the high-pressure fuel is discharged from either one of the high-pressure plungers 61 and 62, the high-pressure fuel is supplied to the common rail 2 by way of both of the high-pressure pipes 11, 12 and hence, the pressures in the inside of the high-pressure pipes 11, 12 are largely lowered compared to a conventional case in which the connection pipe 30 is not provided.

As a result, when the fuel pump 6 is operated and the fuel is injected from the high-pressure plungers 61, 62 with the timing lag, each high-pressure fuel is distributed to the high-pressure pipes 11, 12 by the connection pipe 30 and is supplied to the common rail 2. Accordingly, the pressure resistance specification of the high-pressure pipes 11, 12 can be reduced compared to the corresponding pressure resistance specification of conventional high-pressure pipes 11, 12 and hence, it is possible to decrease wall thicknesses and inner diameter of the high-pressure pipes 11, 12 whereby the miniaturization and the reduction of weight of the high-pressure pipes 11, 12 can be realized. Further, the pressure reduction effect also influences the plunger chambers 61D, 62D of the high-pressure plungers 61, 62 and hence, stresses applied to the cylinders 61A, 62A and cams 64, 65 can be reduced whereby the miniaturization and the reduction of weight of the whole fuel pump 6 can be realized. As a result, the restriction imposed on mounting sizes can be reduced and the degree of freedom of the arrangement of parts can be increased.

Here, the connecting positions of the connection pipe 30 to the high-pressure pipes 11, 12 are not limited to positions explained in conjunction with the above-mentioned embodiment. That is, it is sufficient to select the connecting positions which can, when the high-pressure fuel is injected from either one of the high-pressure plungers 61, 62, eliminate an imbalance that a large pressure acts on only one of the high-pressure pipes 11, 12 due to such high-pressure fuel. For this end, it is preferable to select the connecting points close to the fuel outlet ports 6P1, 6P2. It is more preferable to select the fuel outlet ports 6P1, 6P2 as the connecting positions of the connection pipe 30 with the high-pressure pipes 11, 12.

Although one embodiment of the present invention shown in FIG. 1 has been explained heretofore, the present invention is not limited to this embodiment. For example, the embodiment shown in FIG. 1 shows the example in which the fuel pump 6 includes two high-pressure generating portions (the high-pressure plungers 61, 62), the number of the high-pressure generating portions of the fuel pump 6 is not limited to two and the fuel pump 6 may include an arbitrary number including three or more of high-pressure generating portions. When the fuel pump 6 includes three or more high-pressure generating portions in this manner, the connection pipe which connects the respective high-pressure pipes which are provided corresponding to the respective high-pressure generating portions may be arranged to connect at least two high-pressure generating portions out of these high-pressure generating portions.

Figure 2:
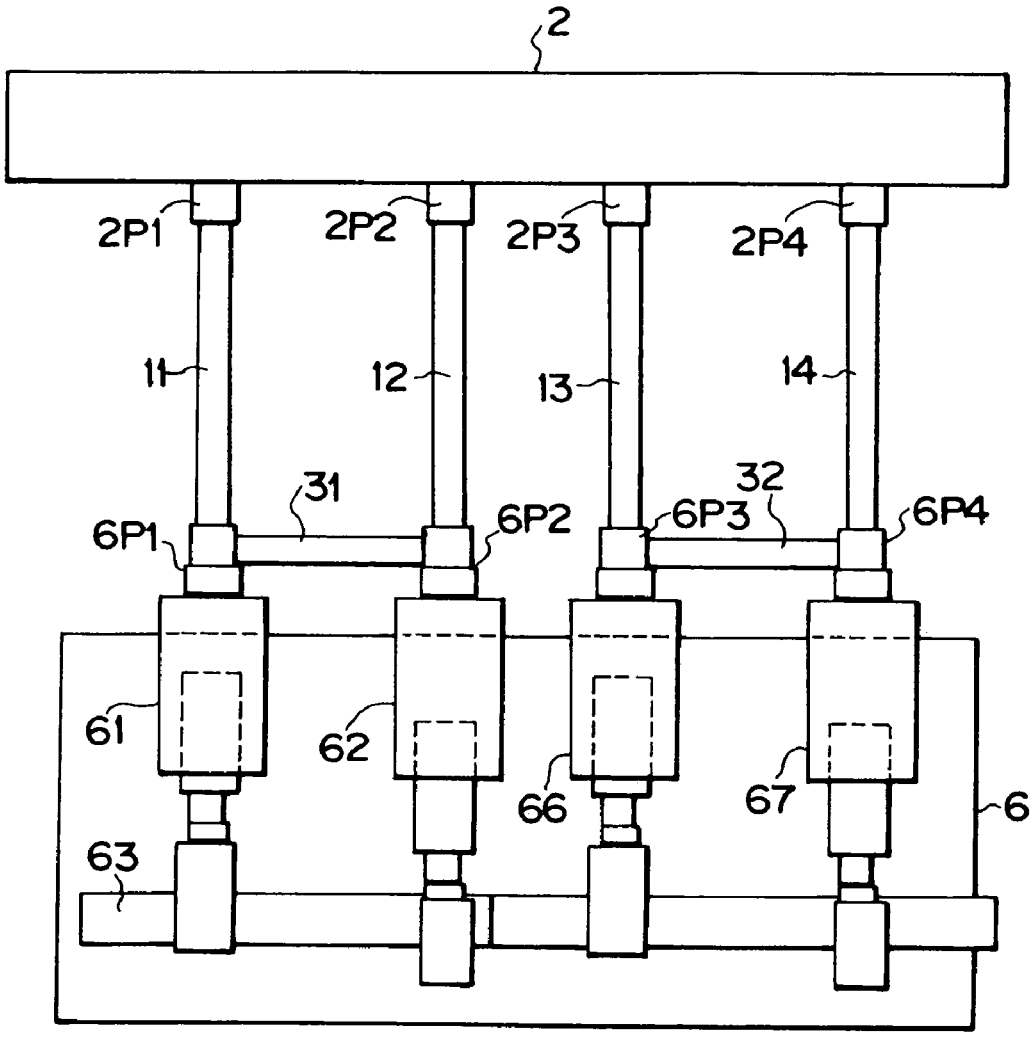
FIG. 2 is a view showing an essential part of another embodiment of the present invention.

FIG. 2 is a view showing an essential part of the embodiment of the fuel supply device according to the present invention when the fuel pump which includes four high-pressure generating portions is used. Here, the fuel pump 6 includes four high-pressure plungers 61, 62, 66, 67, and these high-pressure plungers 61, 62, 66, 67 are respectively connected with inlet ports 2P1 to 2P4 of the common rail 2 by way of high-pressure pipes 11 to 14 which correspond to the high-pressure plungers 61, 62, 66, 67. Further, a fuel outlet port 6P1 of the high-pressure plunger 61 and a fuel outlet port 6P2 of the high-pressure plunger 62 are connected with each other by a connection pipe 31, while a fuel outlet port 6P3 of the high-pressure plunger 66 and the fuel outlet port 6P4 of the high-pressure plunger 67 are connected with each other by way of a connection pipe 32.

As a result, in the constitution shown in FIG. 2, each high-pressure fuel from the high-pressure plungers 61, 62 is distributed to the high-pressure pipes 11, 12. In the same manner, each high-pressure fuel from the high-pressure plungers 66, 67 is distributed to the high-pressure pipes 13, 14. Here, in the embodiment shown in FIG. 2, it is not necessary to provide the injection timing lag to all of the high-pressure plungers 61, 62, 66, 67 and it is sufficient that the injection timing is shifted only between two high-pressure plungers which are connected by the connection pipes 31, 32.

Figure 3:
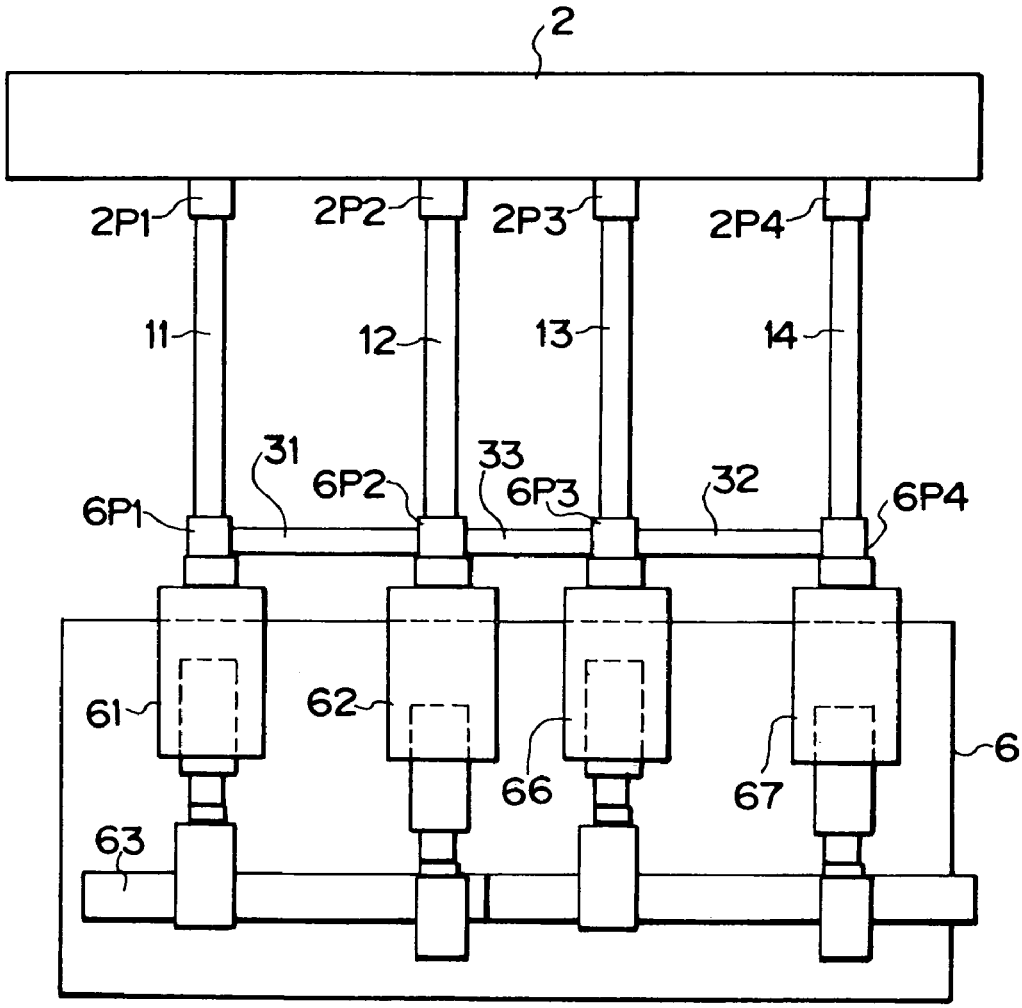
FIG. 3 is a view showing an essential part of still another embodiment of the present invention.

FIG. 3 is a view showing an essential part of another embodiment of the present invention. The embodiment shown in FIG. 3 is characterized in that, in the embodiment shown in FIG. 2, the fuel outlet ports 6P2, 6P3 are connected with each other by another connection pipe 33. Due to such a constitution, all fuel outlet ports 6P1 to 6P4 are connected with each other. In this case, it is necessary that the respective injection timings of the high-pressure plungers 61, 62, 66, 67 are shifted from each other. Here, when the high-pressure fuel is injected from any one of the high-pressure plungers, the high-pressure fuel is distributed into the high-pressure pipes 11 to 14 and is supplied to the common rail 2 and hence, it is possible to obtain a remarkable advantageous effect.

Figure 4:
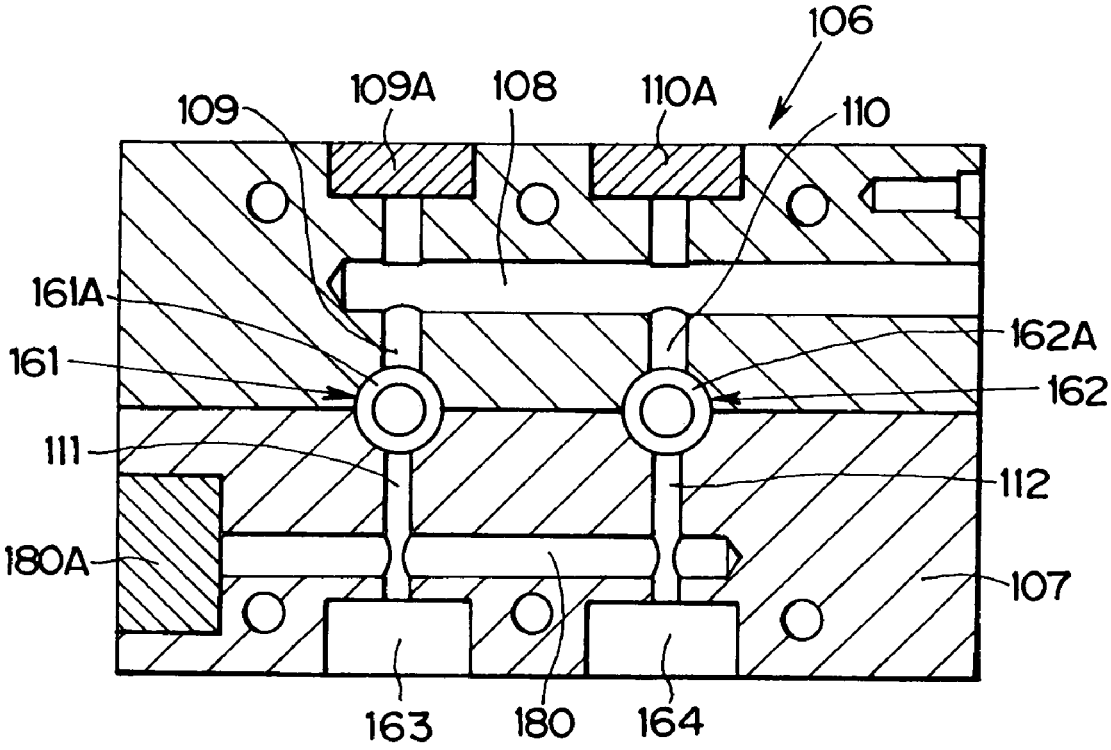
FIG. 4 is a cross-sectional view showing an essential part of a further alternative embodiment of the invention.

FIG. 4 is a view showing further alternative embodiment of the present invention. The embodiment shown in FIG. 4 is directed to a case in which, in the inside of the fuel pump having a plurality of fuel outlet ports, a plurality of the fuel outlet ports are communicated with each other. In FIG. 4, a common rail and a piping system between the common rail and the fuel pump are not illustrated.

The fuel pump 106 shown in FIG. 4 is of a type in which two high-pressure plungers 161, 162 are formed in the inside of a casing block 107. A fuel inlet passage 108 is further formed in the inside of the casing block 107, and fuel which is supplied to the fuel inlet passage 108 from the outside the fuel pump 106 is respectively supplied to plunger chambers 161A, 162A of high-pressure plungers 161, 162 by way of passages 109, 110. The passages 109, 110 are interrupted from the outside of the casing block 107 by means of closing blocks 109A, 110A.

In the casing block 107, the fuel outlet ports 163, 164 are also formed corresponding to the high-pressure plungers 161, 162. The fuel outlet port 163 is communicated with the plunger chamber 161A of the high-pressure plunger 161 by way of a passage 111, while the fuel outlet port 164 is communicated with the plunger chamber 162A of the high-pressure plunger 162 by way of a passage 112. Here, the passages 111, 112 are also formed in the inside of the casing block 107.

Numeral 180 shows a connection pipe which is provided for allowing the fuel outlet ports 163, 164 to communicate with each other. The communication pipe 180 is formed in the inside of the casing block 107, wherein the fuel outlet ports 163, 164 are communicated with each other in the inside of the casing block 107 by the communication pipe 180. Here, the communication pipe 180 is interrupted from the outside of the casing block 107 by means of a closing block 180A. Accordingly, by adopting the constitution shown in FIG. 4, it is possible to obtain the operation and advantageous effects in the same manner as the respective embodiments shown in FIG. 2 and FIG. 3.

INDUSTRIAL APPLICABILITY

As has been described heretofore, according to the present invention, it is possible to realize the miniaturization and the reduction of weight of the fuel pump thus contributing to the improvement of the fuel supply device.

The invention claimed is:

1. A fuel supply device (1) comprising:

a fuel pump (6);

a common rail (2) which accumulates a high-pressure fuel which is supplied from the fuel pump (6) under pressure; and a fuel injection valve (3) which is capable of supplying the high-pressure fuel accumulated in the inside of the common rail (2) to an internal combustion engine, the fuel pump (6) including a plurality of high-pressure generating portions (61, 62, 66 67) whose high-pressure-fuel injection timings are shifted from each other, wherein the fuel supply device (1) includes a plurality of high-pressure pipes (11 to 14) which are provided corresponding to the plurality of high-pressure generating portions (61, 62, 66, 67) and connect fuel outlet ports (6P1 to 6P4) of the corresponding high-pressure generating portions (61, 62, 66, 67) with corresponding inlet ports (2P1 to 2P4) of the common rail (2), and a connection pipe (30 to 33) which connects at least two or more high-pressure pipes (11, 12, 12, 13, 13, 14) out of the plurality of high-pressure pipes (11 to 14) with each other in the vicinity of the corresponding fuel outlet ports (6P1 to 6P4);

characterized in that:

each of the high-pressure pipes (11 to 14) is provided between one inlet port (2P1 to 2P4) and only one of the outlet ports (6P1 to 6P4), wherein each of the high-pressure pipes (11 to 14) is directly connected to only one high-pressure generating portion (61, 62, 66, 67) via the corresponding fuel outlet port (6P1 to 6P4) and an outlet valve (V3, V4) arranged in the fuel pump (6); and the connection pipe (30 to 33) is arranged to directly connect the at least two or more high-pressure pipes (11 to 14) with each other between the both ends of each of the at least two or more high-pressure pipes (11 to 14).

* * * * *